US007837367B2

(12) United States Patent
Huang et al.

(10) Patent No.: US 7,837,367 B2
(45) Date of Patent: Nov. 23, 2010

(54) AUTOMOBILE HEADLIGHT HIGH-LOW SWITCHING DEVICE

(76) Inventors: Hsian-Yi Huang, P.O. Box 90, Tainan City 70499 (TW); Ching-Yun Huang, P.O. Box 90, Tainan City 70499 (TW)

( * ) Notice: Subject to any disclaimer, the term of this patent is extended or adjusted under 35 U.S.C. 154(b) by 223 days.

(21) Appl. No.: 12/328,784

(22) Filed: Dec. 5, 2008

(65) Prior Publication Data

US 2010/0142216 A1 Jun. 10, 2010

(51) Int. Cl.
*F21V 17/02* (2006.01)

(52) U.S. Cl. ..... 362/513; 362/512

(58) Field of Classification Search ..... 362/512, 362/513, 539

See application file for complete search history.

(56) References Cited

U.S. PATENT DOCUMENTS 3,005,374 A * 10/1961 Thomas ..... 359/229

* cited by examiner

*Primary Examiner*—David V Bruce

(57) ABSTRACT

An automobile headlight high-low switching device includes a fixing plate, an electromagnetic valve, a driven device and a light-shielding board. The fixing plate has a recess, a sliding slot and a pivotal pin. The electromagnetic valve is fixed on the fixing plate, provided with a valve shaft mounted with a spring. The driven device is connected with the valve shaft, having a projecting bar at a bottom to plug into the sliding slot. The light-shielding board has a pivotal hole used to be pivotally fixed with the pivotal bar of the fixing plate, a through hole to be inserted through by the projecting bar of the driven device. With the simple components, the automobile headlight high-low switching device can be not only operated smoothly but also assembled quickly to effectively lower manufacturing cost.

4 Claims, 9 Drawing Sheets

AUTOMOBILE HEADLIGHT HIGH-LOW SWITCHING DEVICE

BACKGROUND OF THE INVENTION

1. Field of the Invention

This invention relates to an automobile headlight high-low switching device, particularly to one consisting of a fixing plate, an electromagnetic valve, a driven device and a light-shielding board, which have a simple structure so that they can be swiftly assembled together to lower manufacturing cost; moreover, a valve shaft of the electromagnetic valve can be smoothly moved to and fro.

2. Description of the Prior Art

As shown in FIGS. 1~4, a conventional automobile headlight high-low switching device 1 is installed between a lamp base (A) combined with a light-emitting device (A1) and a transparent mask (B), provided with a fixing plate 11, an electromagnetic valve 12, a light-shielding board 13, a flexible locking member 14, a movable plate 15 and a lining plate 16. The fixing plate 11 is transversely positioned on the lamp base (A), provided with a notch 110 formed at its upper side for corresponding to the light-emitting device (A1), a pivotal base 111 protruded at two sides of the notch 110 respectively, a hole 112 bored next each of the pivotal bases 111, and plural connecting holes 113 properly bored in its lower portion. The electromagnetic valve 12 is fixed with the fixing plate 11 by means of screws (N) screwed in the connecting holes 113, provided with a valve shaft 121 parallel to the notch 110 for being mounted with a conical spring 120. The light-shielding board 13 is provided with a pivotal ear 130 obliquely formed upward at its two sides respectively, and an upper pivotal hole 131 and a lower pivotal hole 132 bored in each of the pivotal ears 130. With the flexible locking member 14 penetrated through the lower pivotal holes 132 to get locked with the pivotal bases 111 of the fixing plate 11, the light-shielding board 13 is closely attached to the notch 110. The movable plate 15 is provided with a groove 150 formed in its intermediate portion for fitting the valve shaft 121 of the electromagnetic valve 12, having its two ends locked in the upper pivotal holes 131 of the light-shielding board 13 by pressing down the conical spring 120. The lining plate 16 is threadably positioned at the bottom of the fixing plate 11, provided with a wing 160 extending sidewise from two sides of an upper portion respectively for covering the holes 112 next to the pivotal bases 111, and plural through holes 161 corresponding to the connecting holes 113 of the fixing plate 11. With the telescopic motion of the valve shaft 121 of the electromagnetic valve 12, the movable plate 15 can be moved down or up to simultaneously keep the light-shielding board 13 swung down or up, so as to shift the projecting size of the light-emitting device (A1) to achieve a high or a low beam.

However, the conventional automobile headlight high-low switching device 1 has the following disadvantages as described below.

1. As too many components, including the fixing plate 11, the electromagnetic valve 12, the light-shielding board 13, the flexible locking member 14, the movable plate 15 and a lining plate 16, are utilized to form the conventional automobile headlight high-low switching device 1, it not only costs high for manufacturing the independent components, but also takes much time for assembling.

2. Moreover, each of the components of the conventional automobile headlight high-low switching device 1 encompasses diverse shapes or parts, such as the pivotal bases 111 of the fixing plate 1 and pivotal holes in the pivotal bases 111, the pivotal ears 130 formed at two sides of the light-shielding board 13 and the upper pivotal holes 131 and the lower pivotal holes 132 in the pivotal ears 130, the movable plate 15, and the lining plate 16 and its through holes 160, it also steps up manufacturing cost and working time.

3. As the pivotal bases 111 are pressed upward at two sides of the notch 110 to have the holes 112 formed next to them, the lining plate 16 is merely employed to cover the holes 120 without any useful function relevant to the conventional automobile headlight high-low switching device 1, just forming an undesirable designing drawback.

SUMMARY OF THE INVENTION

The object of this invention is to offer an automobile headlight high-low switching device that can be not only operated smoothly but also assembled quickly to effectively lower manufacturing cost.

The main characteristics of the invention are a fixing plate, an electromagnetic valve, a driven device and a light-shielding board. The fixing plate is characteristically provided with a sliding slot and a pivotal pin. The driven device is provided with a through hole to be fitted with a connecting projection of a valve shaft of the electromagnetic valve, and a projecting bar formed at a bottom for being inserted into the sliding slot of the fixing plate. The light-shielding board is pivotally connected with the fixing plate and the driven device, utilized to cover the recess of the fixing plate. Provided in one side of the light-shielding board is a pivotal hole that is to be pivotally fitted with the pivotal pin of the fixing plate, and a through hole to be inserted through by the projecting bar of the driven device.

BRIEF DESCRIPTION OF DRAWINGS

This invention is better understood by referring to the accompanying drawings, wherein.

DETAILED DESCRIPTION OF THE PREFERRED EMBODIMENT

Figure 1:
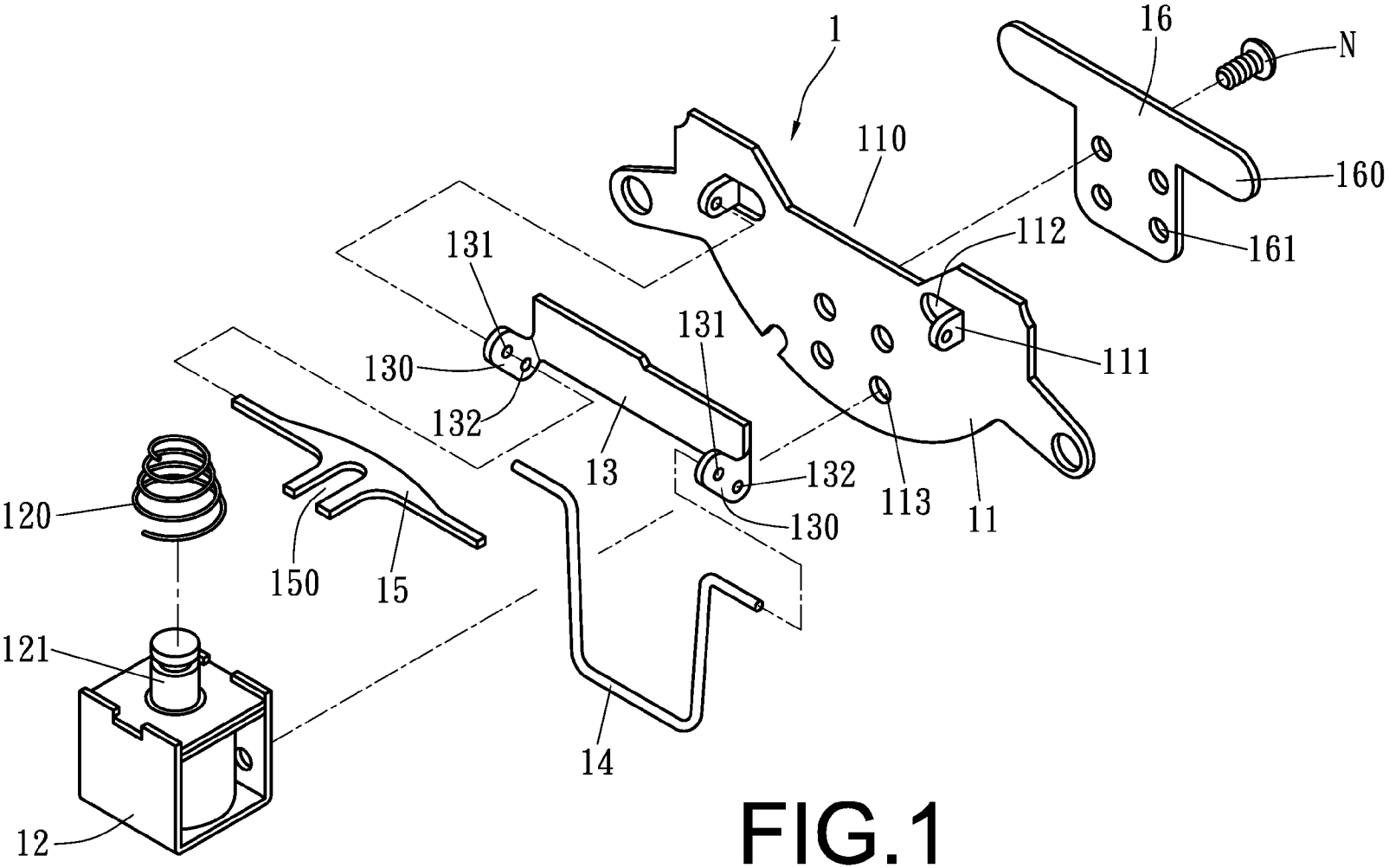
FIG.1 (PRIOR ART)
FIG. 1 is an exploded perspective view of a conventional automobile headlight high-low switching device.
Figure 2:
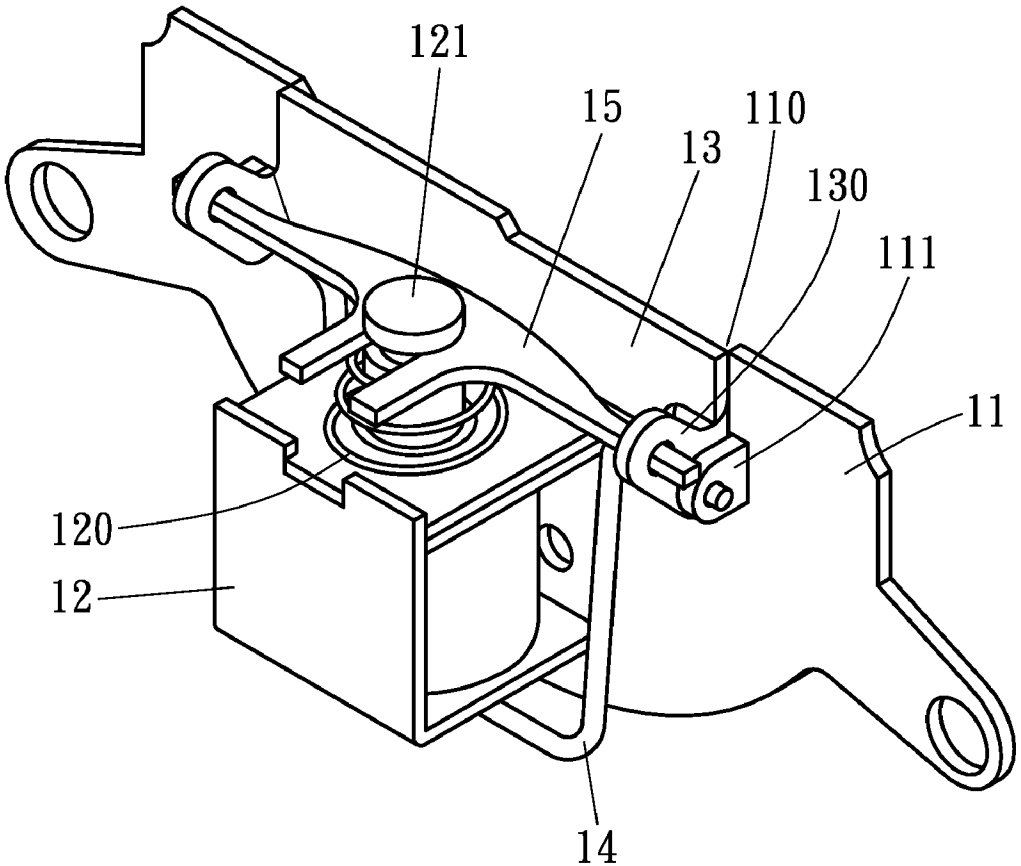
FIG.2 (PRIOR ART)
FIG. 2 is a perspective view of the conventional automobile headlight high-low switching device.
Figure 3:
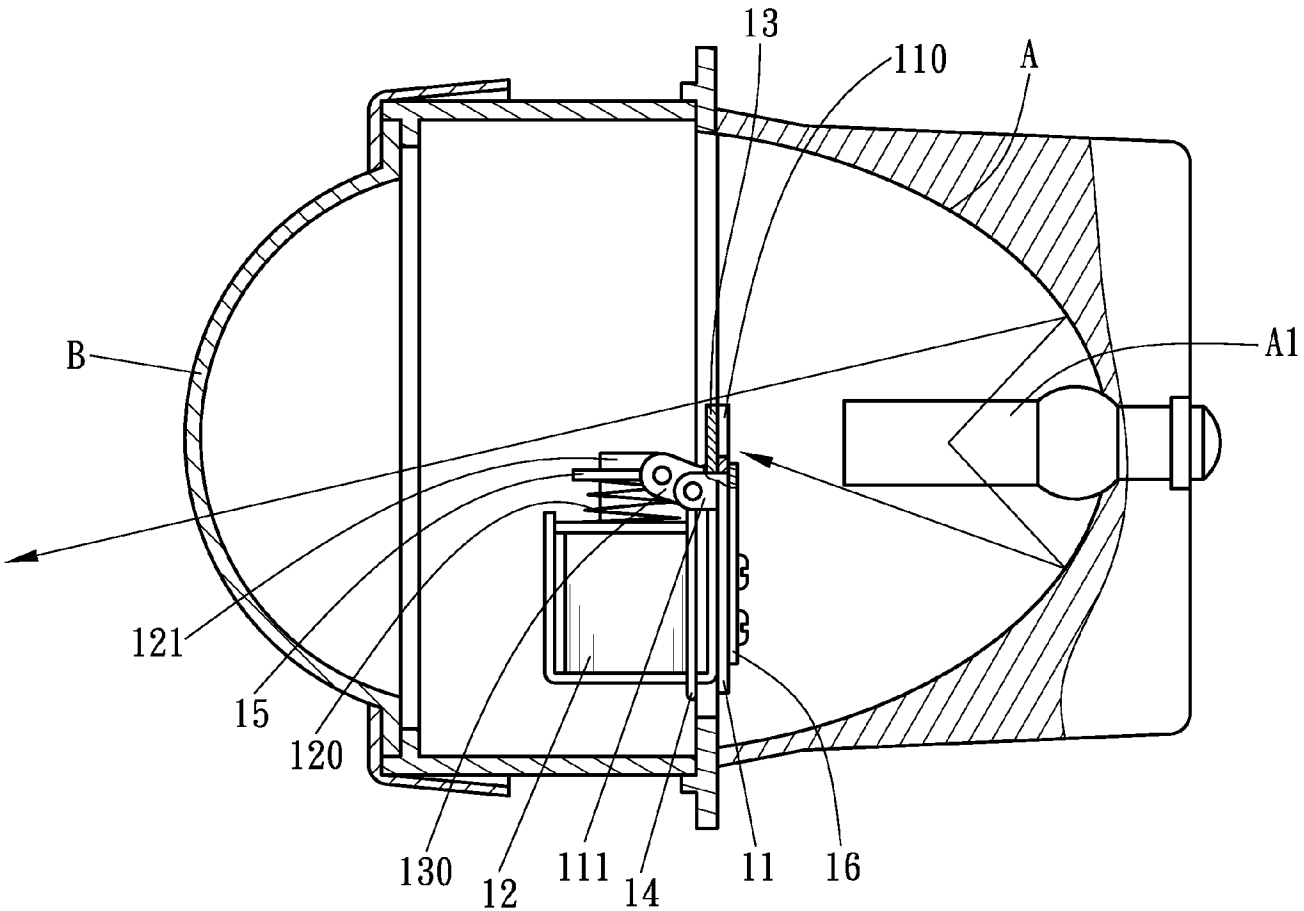
FIG.3 (PRIOR ART)
FIG. 3 is a cross-sectional view of the conventional automobile headlight high-low switching device installed in a headlight, showing it being operated to cut off a refraction of a high beam.
Figure 4:
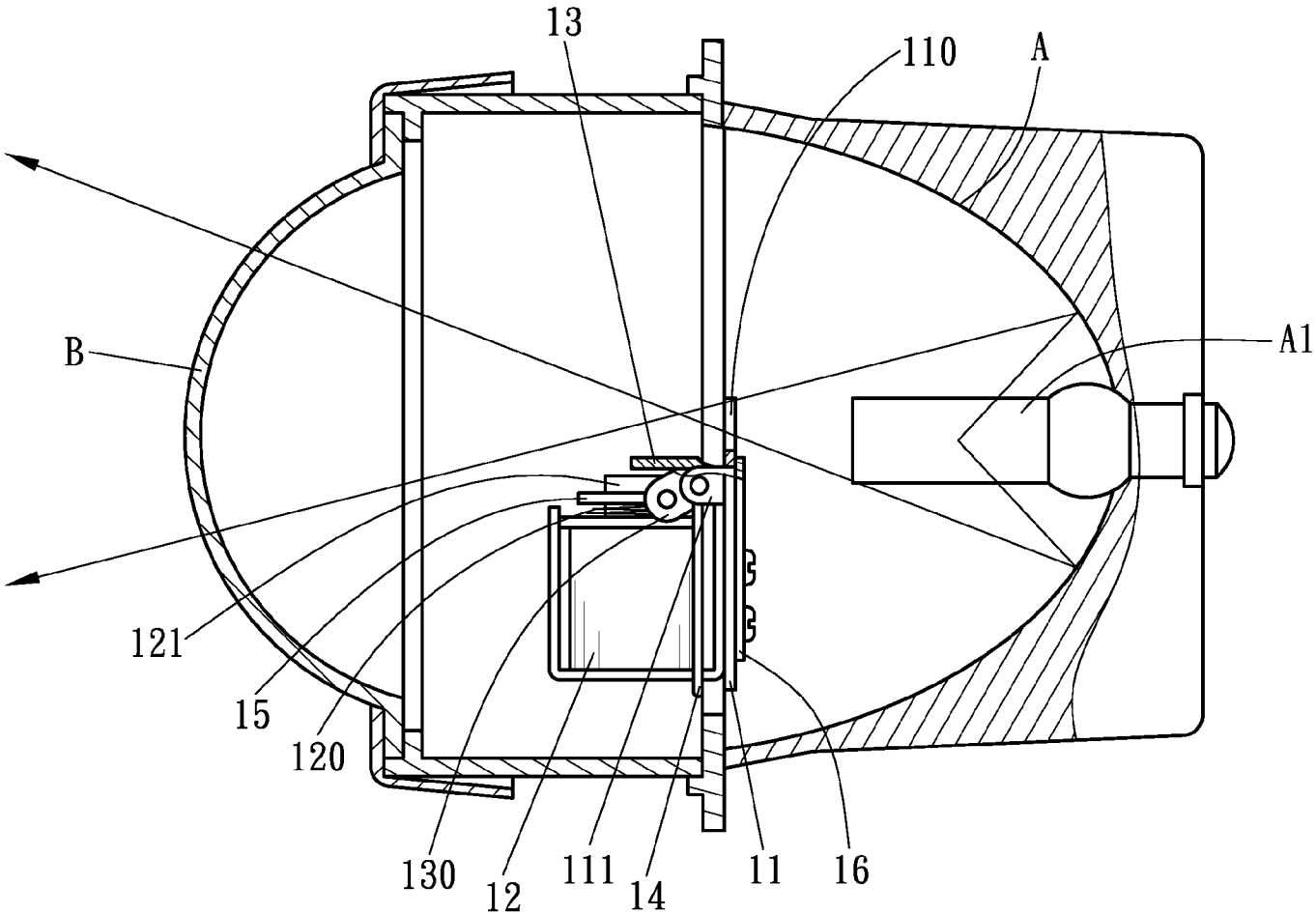
FIG.4 (PRIOR ART)
FIG. 4 is a cross-sectional view of the conventional automobile headlight high-low switching device installed in a headlight, showing it being operated to let the high beam refract outward.
Figure 5:
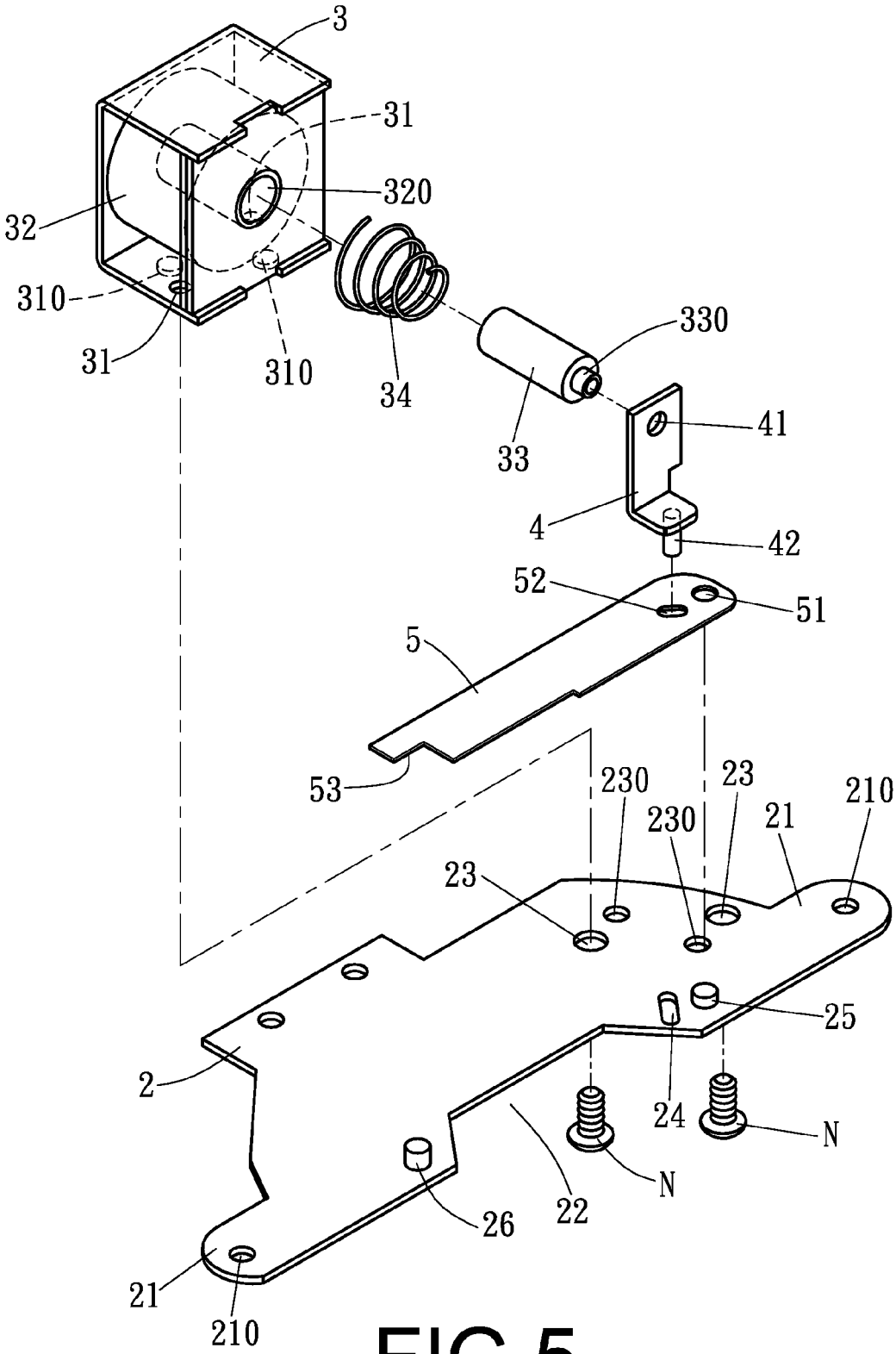
FIG. 5 is an exploded perspective view of a preferred embodiment of an automobile headlight high-low switching device in the present invention.
Figure 6:
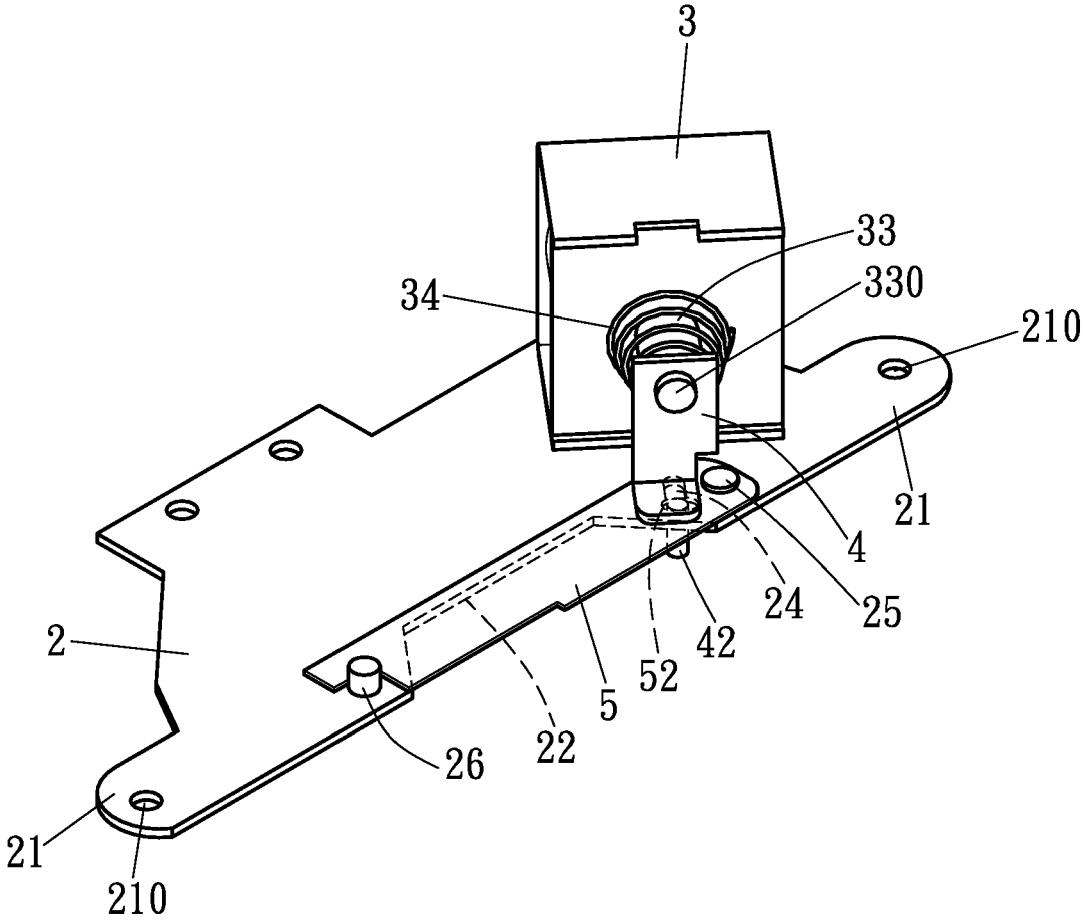
FIG. 6 is a perspective view of the preferred embodiment of an automobile headlight high-low switching device in the present invention.
Figure 7:
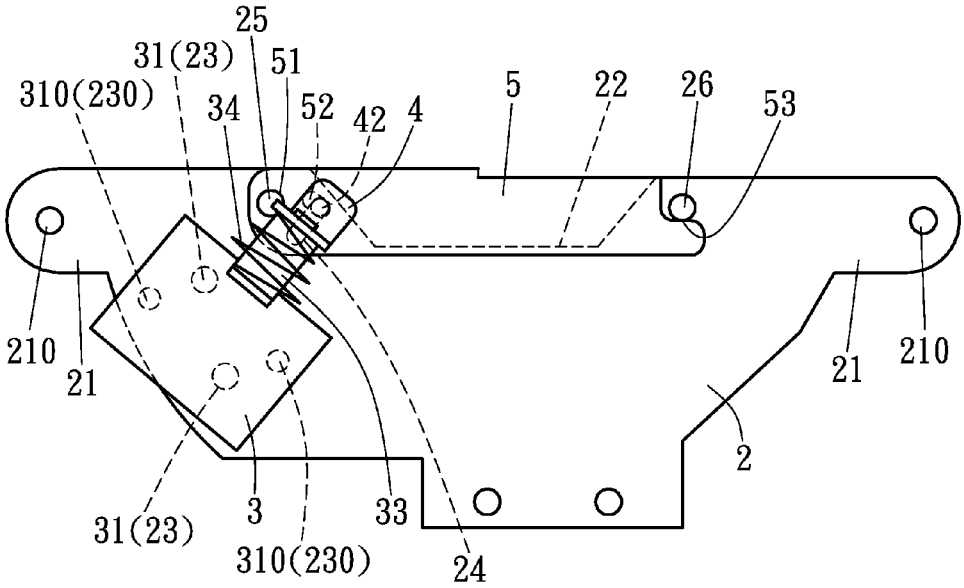
FIG. 7 is a side view of the preferred embodiment of an automobile headlight high-low switching device in the present invention, showing a notch being covered by a light-shielding board.
Figure 8:
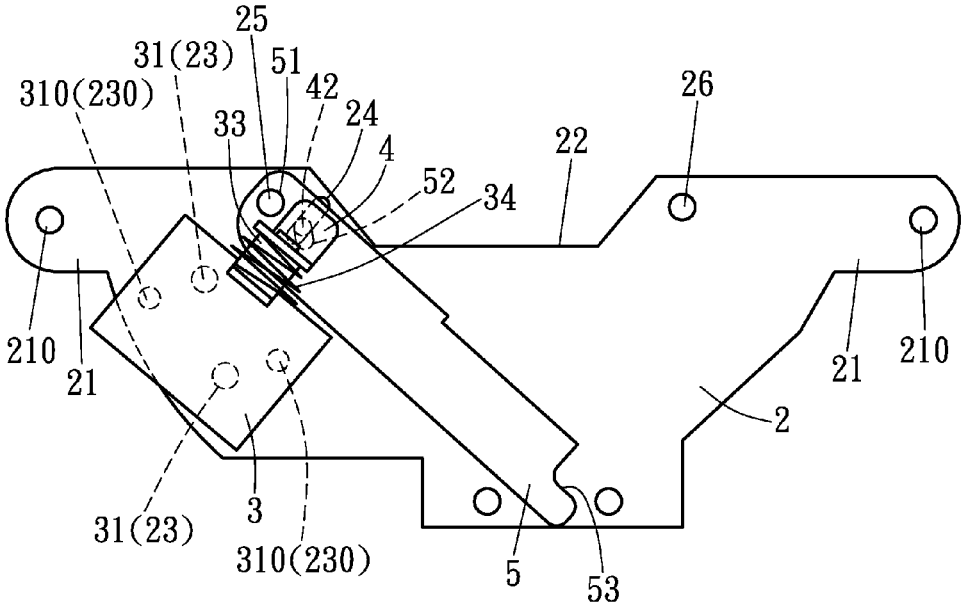
FIG. 8 is a side view of the preferred embodiment of an automobile headlight high-low switching device in the present invention, showing the notch being unblocked by the light-shielding board.
Figure 9:
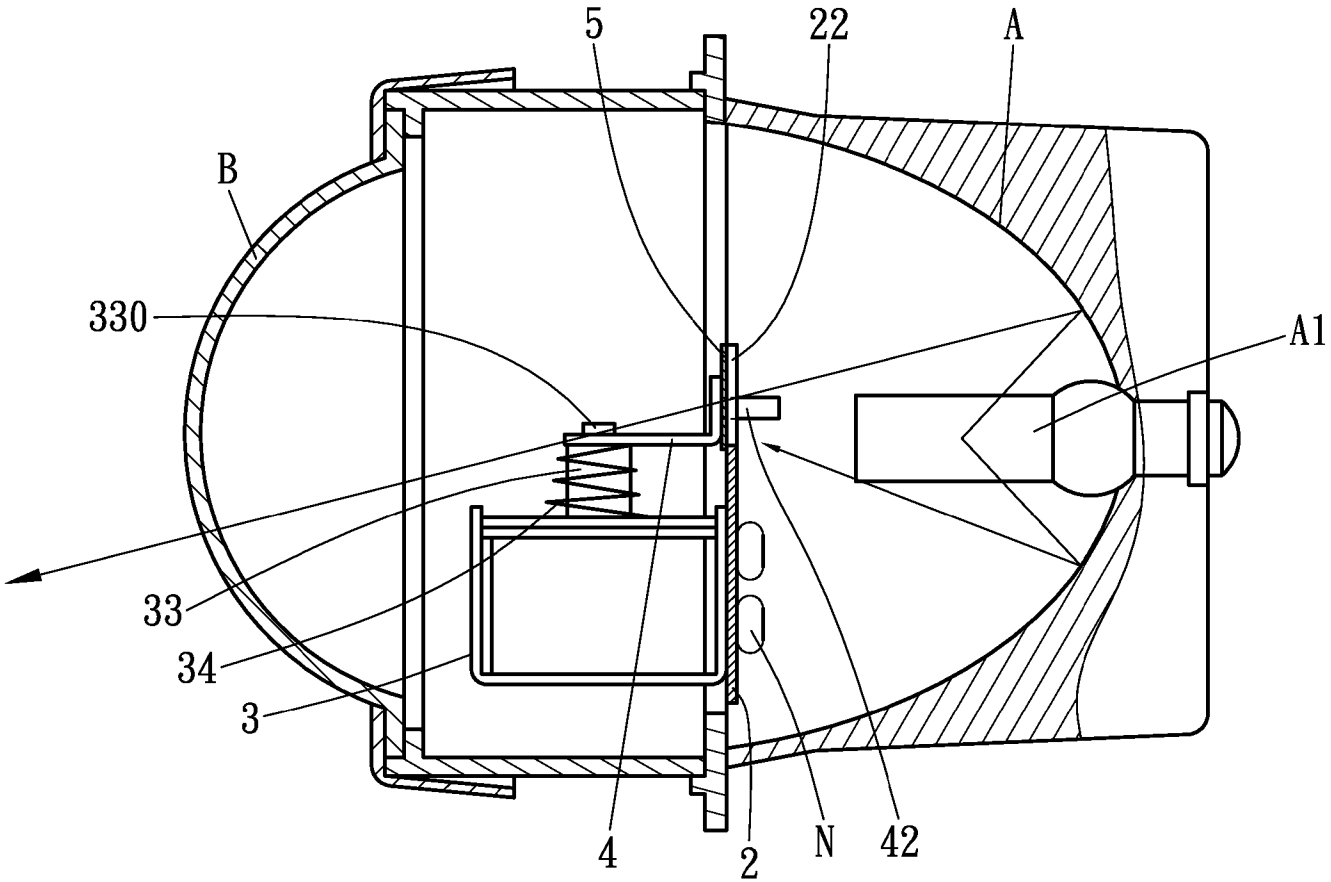
FIG. 9 is a cross-sectional view of the preferred embodiment of an automobile headlight high-low switching device installed in a headlight, showing it being operated to cut off a refraction of a high beam.
Figure 10:
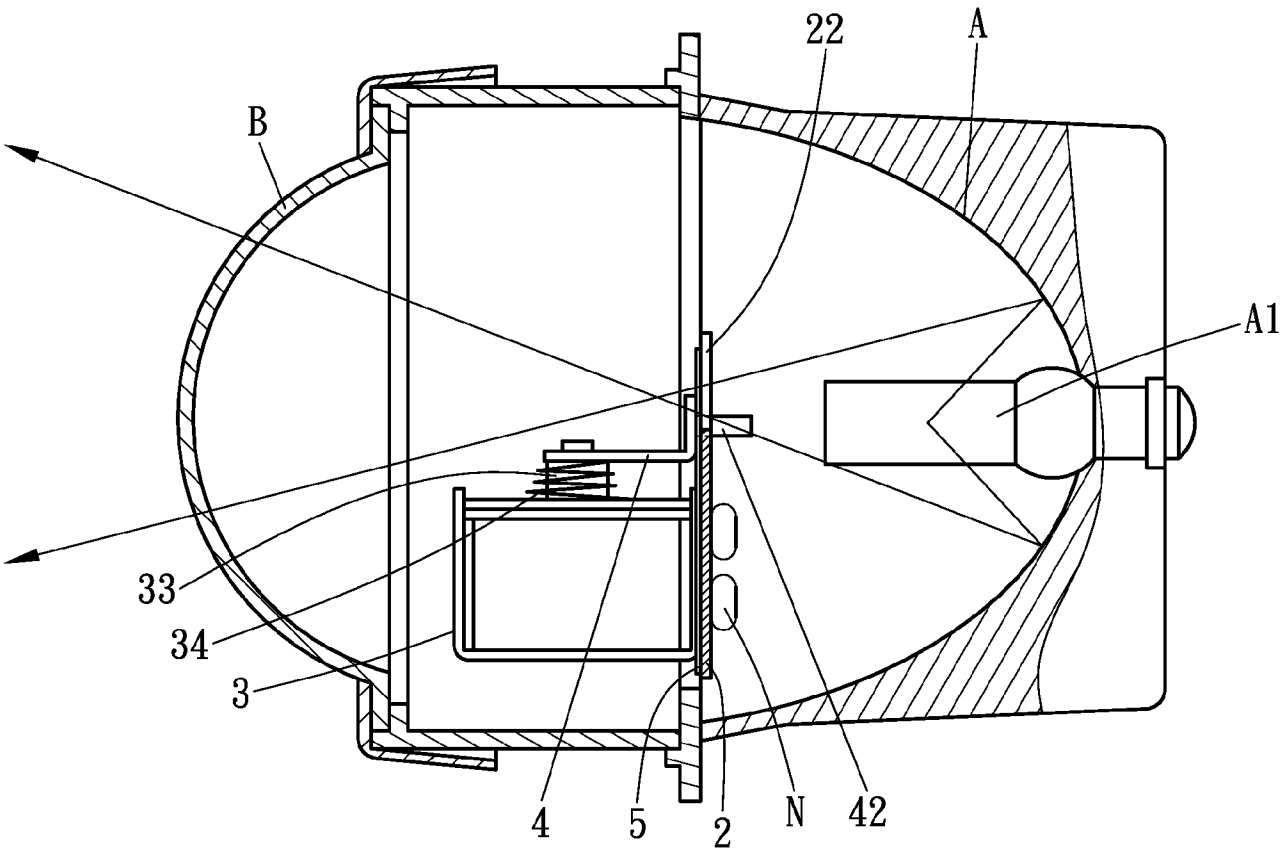
FIG. 10 is a cross-sectional view of the preferred embodiment of an automobile headlight high-low switching device installed in a headlight, showing it being operated to let the high beam refract outward.

As shown in FIGS. 5 and 6, a preferred embodiment of an automobile headlight high-low switching device in the present invention includes a fixing plate 2, an electromagnetic valve 3, a driven device 4 and a light-shielding board 5.

The fixing plate 2 is provided with a positioning wing 21 formed at its two sides respectively, a recess 22 formed in an lower side of an intermediate portion, plural connecting holes 23 and plural fitting holes 230 formed in a right portion, a sliding slot 24 and a pivotal pin 25 located at a right side of the recess 22, and a blocking pin 26 positioned at a left side of the recess 22. Each of the positioning wings 210 is bored with a positioning hole 210.

The electromagnetic valve 3 is fixed on the fixing plate 2, provided with plural connecting holes 31 bored in its bottom for being correspondingly fixed with the connecting holes 23 of the fixing plate 2 by screws (N), and plural projections 310 correspondingly fitted in the fitting holes 230 of the fixing plate 2. Centrally inserted in the electromagnetic valve 3 is a coil 32 with a copper tube 320 in the center for a valve shaft 33 with a spring 34 to extend into the copper tube 320. Formed at the front of the valve shaft 33 is a connecting projection 330.

The driven device 4 is formed like an L and connected with the valve shaft 33 of the electromagnetic valve 3, provided with a through hole 41 to be fitted with the connecting projection 330 of the valve shaft 33, and a projecting bar 42 formed at a bottom for inserting into the sliding slot 24 of the fixing plate 2.

The light-shielding board 5 is pivotally connected with the fixing plate 2 and the driven device 4, utilized to cover the recess 22 of the fixing plate 2. The light-shielding board 5 is provided with a pivotal hole 51 bored in a one side for being pivotally fitted with the pivotal pin 25 of the fixing plate 2, a through hole 52 bored next to the pivotal hole 51 to correspond to the sliding slot 24 of the fixing plate 2 for being inserted through by the projection 42 of the driven device 4, and a blocking portion 53 formed at a left side.

In assembling, as shown in FIGS. 5 and 6, the pivotal pin 25 of the fixing plate 2 is first fitted in the pivotal hole 51 of the light-shielding board 5, and then they are pivotally fixed together by pressing, with the through hole 52 of the light-shielding board 5 corresponding to the sliding slot 24 of the fixing plate 2 and with the blocking portion 53 of the light-shielding board 5 stopped by the blocking pin 26 of the fixing plate 2, so that the recess 22 of the fixing plate 2 is exactly covered by the light-shielding board 5. Next, the valve shaft 33 is mounted by the spring 34 and then inserted into the copper tube 320 of the coil 32. Then, the connecting projection 330 of the valve shaft 33 is fitted and pivotally fixed by pressing in the through hole 41 of the driven device 4 that thus becomes immovable. The projecting bar 42 of the driven device 4 is successively inserted through the through hole 52 of the light-shielding board 5 into the sliding slot 24 of the fixing plate 2, with the projections 310 of the electromagnetic valve 3 fitted in the fitting holes 230 of the fixing plate 2 and with the connecting holes 31 of the electromagnetic valve 3 correspondingly fixed with the connecting holes 230 of the fixing plate 2 by means of screws (N). So, the assembly of the automobile headlight high-low switching device of this invention is finished.

In using, as shown in FIGS. 6~10, when the electromagnetic valve 3 is electrified, it produces magnetism to attract the valve shaft 33 to move inward so as to draw the driven device 4 to compress the spring 34. By the time, the projecting bar 42 of the driven device 4 is to move along the sliding slot 24 to drive the light-shielding board 5 to swing. That is, with the pivotal connection of the pivotal hole 51 fitted with the pivotal bar 25 functioning as a pivot, the free end of the light-shielding board 5 is to accordingly swing off the recess 22 to keep it unblocked, so that the light of the high beam can be refracted outward. On the contrary, when power is disconnected from the electromagnetic valve 3, the spring 34 is immediately to elastically extend outward to push the driven device 4 to move forward and the light-shielding board 5 is surely repositioned to cover the recess 22 of the fixing plate 2, cutting off the refraction of the high beam.

As can be seen from the foresaid description, the automobile headlight high-low switching device of the invention is different from the conventional one, having less components to simplify assembly and to lower cost accordingly. It is to be noted that as the copper tube 320 is made of metal, it can be prevented from deforming caused by high temperature of the coil 32 of the electromagnetic valve 3, enabling the valve shaft 32 to smoothly move along the copper tube 320. Therefore, it is obvious that the automobile headlight high-low switching device of the invention is not only economically manufactured, but also able to be operated smoothly.

While the preferred embodiment of the invention has been described above, it will be recognized and understood that various modifications may be made therein and the appended claims are intended to cover all such modifications that may fall within the spirit and scope of the invention.

What is claimed is:

1. An automobile headlight high-low switching device comprising:

a fixing plate provided with a positioning wing formed at two sides respectively, each of said positioning wings bored with a positioning hole, a recess formed in a lower side of an intermediate portion of said fixing plate, plural connecting holes, a sliding slot and a pivotal pin bored in said fixing plate;

an electromagnetic valve fixed on said fixing plate and provided with plural connecting holes bored in a bottom for being correspondingly fixed with said connecting holes of said fixing plate by screws, a valve shaft installed in said electromagnetic valve and mounted with a spring, said valve shaft having a connecting projection formed at a front end;

a driven device connected with said valve shaft of said electromagnetic valve and provided with a through hole to be fixed together with said valve shaft, a projecting bar formed at a bottom of said driven device for inserting into said sliding slot of said fixing plate; and a light-shielding board pivotally connected with said fixing plate and said driven device for covering said recess of said fixing plate, said light-shielding board provided with a pivotal hole and a through hole bored in its one side, said pivotal hole utilized to be pivotally fixed with said pivotal pin of said fixing plate, said through hole employed to be inserted through by said projecting bar of said driven device.

2. The automobile headlight high-low switching device as claimed in claim 1, wherein said fixing plate is provided with plural fitting holes for being correspondingly fitted by plural projections formed at a bottom of said electromagnetic valve.

3. The automobile headlight high-low switching device as claimed in claim 1, wherein said fixing plate is additionally provided with a blocking pin positioned at one side of said recess to correspond to a blocking portion provided in said light-shielding board.

4. The automobile headlight high-low switching device as claimed in claim 1, wherein said electromagnetic valve is provided with a coil in an interior portion, and said coil has a copper tube deposited in a center.

* * * * *